US007399380B2

(12) United States Patent
Ferm et al.

(10) Patent No.: US 7,399,380 B2
(45) Date of Patent: Jul. 15, 2008

(54) JET VELOCITY VECTOR PROFILE MEASUREMENT AND CONTROL

(75) Inventors: Johan Ferm, Mellerud (SE); Anders Hübinette, Väse (SE); Ross K. MacHattie, Mississauga (CA); Anders Hallgren, Gustavsberg (SE); John F. Shakespeare, Kuopio (FI)

(73) Assignee: Honeywell International Inc., Morristwon, NJ (US)

( * ) Notice: Subject to any disclaimer, the term of this patent is extended or adjusted under 35 U.S.C. 154(b) by 501 days.

(21) Appl. No.: 10/986,343

(22) Filed: Nov. 10, 2004

(65) Prior Publication Data

US 2006/0096727 A1 May 11, 2006

(51) Int. Cl.
*D21F 7/06* (2006.01)
*D21F 1/02* (2006.01)
*D21F 1/06* (2006.01)

(52) U.S. Cl. ..... 162/198; 162/259; 162/263; 162/DIG. 11; 700/129

(58) Field of Classification Search ..... 162/198, 162/212, 262, 263, 252, 253, 259, 344, 346, 162/DIG. 10, DIG. 11; 700/127–129
See application file for complete search history.

(56) References Cited

FOREIGN PATENT DOCUMENTS

| | | | |
|---|---|---|---|
| JP | 3-45795 | * | 2/1991 |
| JP | 2000-144597 | * | 5/2000 |
| WO | WO 01/53603 | * | 7/2001 |

* cited by examiner

*Primary Examiner*—Eric Hug
(74) *Attorney, Agent, or Firm*—Munck Butrus Carter, PC

(57) ABSTRACT

In a papermaking system having a headbox to dispense a jet of liquid and paper forming fibers, an improvement comprising at least one sensor arrangement for simultaneously or sequentially measuring in at least one location the jet velocity or jet flow correlation of the jet at plural known angles relative to the machine direction. The measured data is analyzed to generate a velocity vector profile or velocity direction profile of the jet, and hence to determine the profile of fiber orientation angles laid down in the sheet formed of the jet.

26 Claims, 9 Drawing Sheets

JET VELOCITY VECTOR PROFILE MEASUREMENT AND CONTROL

FIELD OF THE INVENTION

This invention relates generally to the field of papermaking, and particularly to a system for measuring and controlling the velocity or direction of a jet emerging from a slice in a head box.

BACKGROUND OF THE INVENTION

In the field of papermaking, the production of a sheet of paper begins at a headbox which contains a slurry of liquid and pulp containing paper forming fibers. The headbox has an elongated opening or slice lip through which the slurry under pressure is deposited onto a moving Fourdrinier wire or screen. The screen assists in separating the fibers from the liquid to create a web of material which is the initial step in the papermaking process.

At the headbox, the slurry is deposited onto the wire and travels in the machine direction (MD). A series of actuators arranged along the cross-direction (CD) of the papermaking machine (transverse to the machine direction) control locally the size of the slice opening to permit the passage of greater or lesser amounts of slurry from the opening. The headbox is the primary means for controlling the quality and grade of the paper being manufactured.

An important factor in controlling the quality and grade of the paper is monitoring the Fiber Orientation of fibers emerging from the headbox. Fiber Orientation (FO) is the term used to discuss how fibers lay horizontally within a sheet of paper or board. Identifying the direction in which the majority of fibers are aligned (Fiber Orientation Angle) and the degree of alignment (Fiber Ratio, Aspect Ratio, or Index), characterizes the Fiber Orientation. Fiber Orientation Angle is the direction the majority of the fibers are laying with respect to the machine direction. Fiber Ratio is a measurement of the anisotropy (exhibiting properties with different values when measured in different directions), or percentage of fibers not lying in the Fiber Orientation direction. The Aspect Ratio describes the relative numbers of fibers oriented with the Fiber Orientation Angle and perpendicular to the Fiber Orientation Angle. Undesirable Fiber Orientation can reduce paper runnability during printing and converting operations, causing such problems as curl, stack lean, twist warp, miss-registration, and others. Since Fiber Orientation is determined between the stock approach system at the headbox and the dry-line on the forming table at the Fourdrinier wire, potential "handles" for affecting Fiber Orientation are also found in this area of the machine.

In conventional arrangements, most of the headbox delivery system components are manually adjusted, such as headbox balance (re-circulation), manifold bellows, edge flows and cheek bleeds. Unbalanced headboxes can cause cross flows within the headbox which tend to align fibers detrimentally. The manifold bellows give some headboxes the ability to change the pressures or flows non-linearly across the box. Edge flows give the ability to control fiber angle using extra flows on the sides of the headbox. Cheek bleed removes stock off the sides of the headbox, or reverse bleed injects stock back into the headbox edges. Any modification of the "bleed" flows on the side of the headbox will significantly affect fiber angle. Most of the affect will be on the outside edges of the sheet where fiber angle is usually the largest problem. Hang-down or "stick" is the distance the slice lip hangs below the front wall, and has a significant effect on the turbulent flow of stock onto the breast roll. Additionally, the front wall can often be moved horizontally, as can the apron, which changes the impingement angle. Another adjustment for Fiber Orientation within many headboxes are rectifier rolls, which are drilled rolls that turn in various directions at various speeds to induce turbulence in the stock. Dilution flow control or Consistency Profiling and similar retrofit systems such as the BTF Distributor, affect basis weight discretely across the width of the machine, so with the use of a slice lip, it is possible to control the relative velocities independently from the basis weight. This allows both basis weight and Fiber Orientation to be simultaneously and independently optimized.

Current paper manufacturing machines often rely on measurement schemes that determine Fiber Orientation of the finished product. Measuring the Fiber Orientation of finished product (at the dry-end) has several problems. One problem is that different running conditions make it impossible to correctly control Fiber Orientation, since these varying conditions can change both the gain and its sign for the control. As the Fiber Index approaches one, where the sheet is described as "square", dry-end measurements have a very difficult time determining the direction and magnitude of the Fiber Orientation. Additionally, dry-end measurements are only good for either bulk or at best top and bottom fiber orientation measurements, and cannot provide adequate information about middle layers in a multi-layer product. Separate Fiber Orientation information from the separate layers will also make it possible to repeat the same quality on different grade runs. It may also facilitate the development of new grades with improved properties.

In 1971, a system for measuring the velocity of a jet emerging from a head box in a paper manufacturing system was patented by Industrial Nucleonics Corporation (U.S. Pat. No. 3,620,914). This reference discloses that: "Jet velocity is determined by measuring the Doppler shift frequency caused by the jet on a laser beam of coherent electromagnetic energy. The velocity of the jet is compared with the velocity of a Fourdrinier wire which receives the jet, whereby there is derived a signal for enabling a predetermined relative velocity between the jet and the wire to be automatically or manually maintained. The laser beam is scanned across the width of the jet to determine differences in the jet velocity as a function of width."

In 1989 Beloit Corporation received U.S. Pat. No. 4,856,895 directed to a method of measuring the jet velocity. The patent relies on measurement of the velocity of a liquid jet from the headbox. The patent states: "The velocity of a liquid jet, such as the headbox jet of a paper making machine, is measured by cross-correlation of a.c. signal components produced by a pair of light beams received by a pair of photodiodes. The light is supplied by a single source, an incandescent lamp, and is guided by a pair of bifurcated fiber optics mounted above the jet and spaced apart in the flow direction. The a.c. components are filtered to remove flow frequencies, amplified and then analyzed in a spectrum analyzer."

In 1992, the Weyerhaeuser Company received U.S. Pat. No. 5,145,560 which is also directed to monitoring of headbox jet velocity. This reference discloses that: "The jet velocity along a slice opening of a papermaking machine is monitored at plural locations to provide a jet velocity profile. This jet velocity profile may be adjusted to more closely match a reference velocity profile for the jet. Preferably, microwave Doppler effect velocity sensors are utilized for sensing a jet velocity."

In 2000, the Voith Paper Company received EP Patent No. EP 1116825A entitled "Method for Fiber Orientation Control", which describes a method to measure and control a cross-machine velocity profile of a fibrous stock suspension jet at the outlet from the flow box nozzle.

In 2002, Honeywell International received U.S. Pat. No. 6,437,855 entitled "Laser Doppler Velocimeter With High Immunity to Phase Noise". A true Doppler frequency is extracted from the phase noise frequencies by maintaining a highest frequency value. The highest frequency value is replaced with any measured frequency values that are higher than the current highest frequency value. This is continued for a predetermined lifetime period, after which the highest frequency value is stored and then reinitialized. The highest detected frequency values over a window of lifetimes are then averaged to provide a moving or rolling average value, which is indicative of the velocity of a medium.

Also in 2002, Stora Enso presented a paper at the SPCI 2002 Controls Conference entitled "Jet Misalignment, "The Missing Link" in Headbox Control is Now Available", by Ulf Andersson, Research Engineer Packaging Board Stora Enso Research, Karlstad PO Box 9090 S-650 09 Karlstad, Sweden. This paper was based upon Swedish Patent No. 515640 issued Sep. 17, 2001 to Stora Kopparbergs Bergslags AB.

SUMMARY OF THE INVENTION

The present invention provides a headbox jet velocity vector profile system that can quickly and accurately determine the jet velocity vector profile. The fundamental difference between this invention and the prior art is that we have methods that produce the velocity vector quickly making the system useful for reacting to startups or major upsets. This makes the present invention particularly suited for performing grade changes among other things. In one aspect of the invention, by measuring jet speed from plural angles simultaneously and calculating the velocity vector from the component or components we measure, we increase the speed of results significantly. In another aspect of the invention, by measuring the jet flow correlation at plural angles sequentially, the jet flow direction can be inferred with high accuracy. We also increase the reliability of the system significantly by reducing the mechanical complexity and remove rotational elements, which are is significant maintenance issues. Our approach also utilizes components that are proven to withstand the harsh environment in the vicinity of the jet from a headbox, and is therefore commercially viable.

By measuring the velocity vector profile of the stock jet itself, and possibly the wire speed too, a transformation can be performed to convert the jet-speed measurements into a fiber orientation measurement. This measurement is then immune from the gain and sign problems noted above. By measuring the jet velocity at a given point with more than one measurement separated by a given angle at the same time, or in rapid succession, it is possible to get a good correlation to fiber orientation and a stable signal for the profile control. This also means that the sensor can be scanned at a reasonable speed to produce profiles in real-time. It is also then possible to measure the jet velocity vector profile directly of any ply in a multiply product and control them separately.

Accordingly, in a first aspect, the present invention provides in a papermaking system having a headbox to dispense a jet of liquid and paper forming fibres, the improvement comprising:

at least one arrangement of sensors for substantially simultaneously measuring the velocity of the jet at a location in at least two known angles relative to the machine direction, and generating velocity data;

means for storing the velocity data to generate a velocity vector profile of the jet; and means for analyzing the velocity vector profile to determine the orientation of the fibres within the jet.

In a further aspect, the present invention provides a method of monitoring the velocity of a jet of liquid and paper forming fibres emerging in a jet from an elongated opening headbox of a papermaking machine comprising:

measuring the velocity of the jet substantially simultaneously at a location at at least two known angles to the machine direction to generate velocity data;

creating a velocity vector profile of the jet using the velocity data; and analyzing the velocity vector profile to determine the orientation of the fibres within the jet.

In yet another aspect, which is additional or alternative to the preceding aspects, the present invention provides a method of monitoring the velocity of a jet of liquid and paper forming fibres emerging in a jet from an elongated opening headbox of a papermaking machine comprising:

measuring a flow correlation of the jet using at least one sensor having a known alignment angle relative to the machine direction for said at least one sensor;

traversing said at least one sensor using at least one known traverse speed in at least one traverse direction across the jet, such that the flow correlation is measured at a measurement angle formed by the sum of the sensor alignment angle and the bias angle due to the movement of the sensor relative to the jet;

recording the flow correlation measurements at plural measurement angles at each of plural locations across the jet; and estimating the direction relative to the machine direction in which the flow correlation is maximum at each measurement location from said recorded flow correlation measurements.

In a still further aspect, the present invention provides in a papermaking system having a headbox to dispense a jet of liquid and paper forming fibers, the improvement comprising:

at least one sensor for measuring the flow correlation of the jet, the alignment angle relative to the machine direction being known for each of said at least one sensor;

means for traversing said at least one sensor using at least one known traverse speed in at least one traverse direction across the jet, such that the flow correlation is measured at a measurement angle formed by the sum of the sensor alignment angle and the bias angle due to the movement of the sensor relative to the jet;

means for recording the flow correlation measurements at plural measurement angles at each of plural locations across the jet; and means for estimating the direction relative to the machine direction in which the flow correlation is maximum at each measurement location from said recorded flow correlation measurements.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
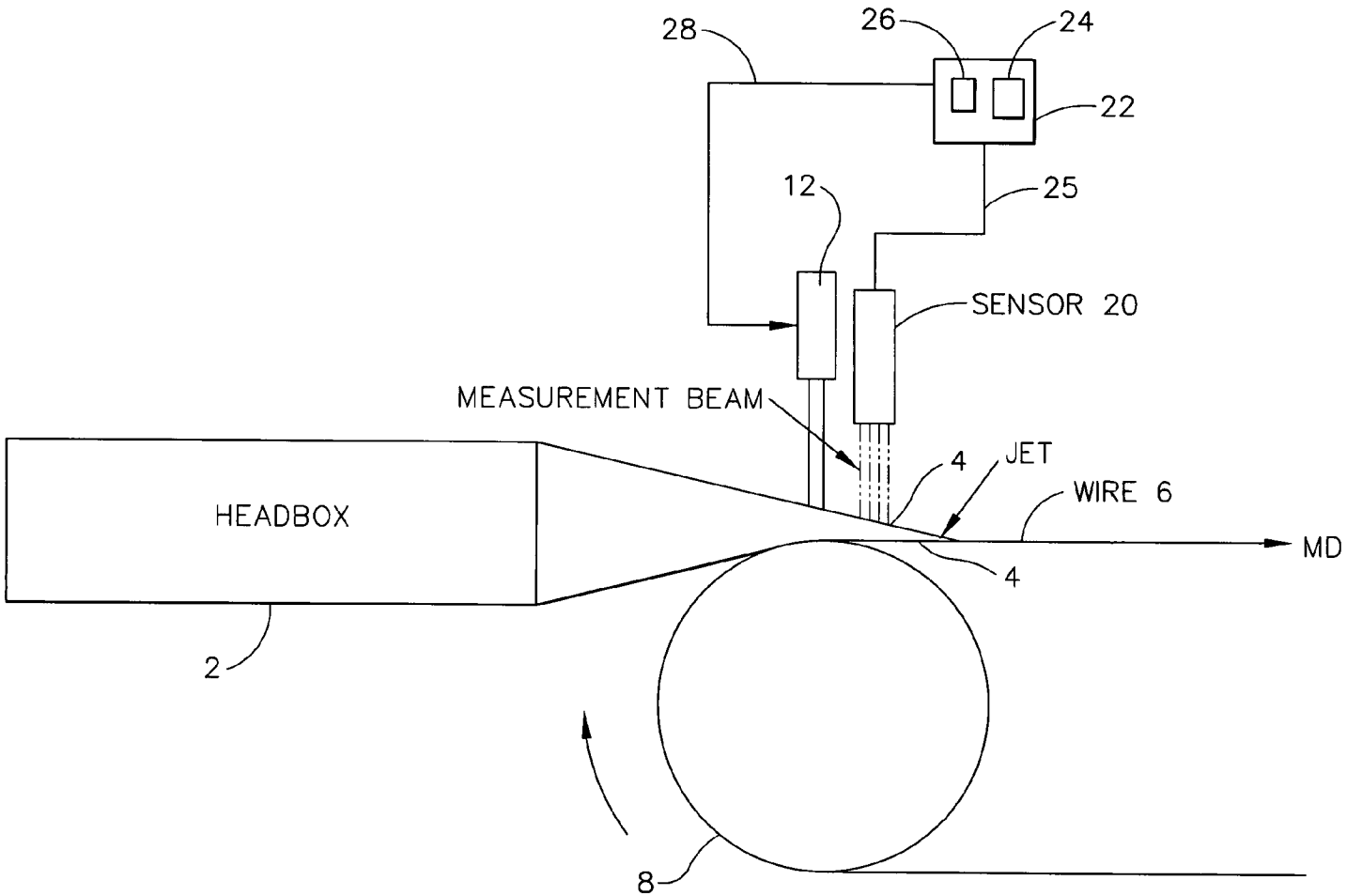
FIG. 1 is a schematic elevation view of the jet velocity profile measurement and control system of the present invention.

Referring to FIG. 1, there is shown schematically a headbox arrangement incorporating the present invention. The headbox 2 dispenses a jet 4 of liquid and paper forming fibers onto a moving Fourdrinier wire or screen 6. The headbox contains a slurry of liquid and paper forming fibers which is generally agitated in some manner to maintain a uniform mixture. Screen 6 moves in the machine direction (MD) by virtue of being an endless loop which is wound about rollers 8 rotating in a clockwise direction as indicated by arrow 9 in FIG. 1. An elongated slice opening 10 extends in the cross-machine direction (CD) transverse to the machine direction and provides an exit through which jet 4 leaves headbox 2 to form a liquid/fiber mat on screen 6. Screen 6 allows for liquid to drain rapidly from the mat leaving fibers orientated on the mat. A plurality of slice opening actuators 12 are arranged along the slice opening at space intervals to locally control the dimensions of the opening and thereby the velocity of the jet issuing from slice opening 10.

According to the present invention, at least one arrangement of sensors 20 is provided for simultaneously measuring the velocity of the jet at a location in the machine direction and at a location at an angle to the machine direction in order to generate velocity data for jet 4 issuing from the headbox. Preferably, there is a sensor array 20 associated with each slice opening actuator 12. The generated velocity data is communicated to means for storing the velocity data in the form of a computer 22 with memory 24 to generate a velocity vector profile of the jet. While FIG. 1 shows the communication between sensor array 20 and computer being by wire 25, this is by way of example only. It is contemplated that sensor array 20 and computer 22 can also communicate wirelessly.

Computer 22 includes means for analyzing the velocity vector profile to determine the orientation of the fibres within the jet in the form of a central processing unit (CPU) 26 of the computer running a program that performs a transformation function that uses the velocity data to establish a profile of the orientation of the fibers. Based on the fiber orientation profile, computer 22 can also send a control signal to slice lip actuator 12, or any other actuator that is used to influence fiber orientation, as indicated by communication line 28 to establish a feedback loop such that the fiber orientation is continuously monitored and adjusted. Central processing unit 26 may be a centrally located unit that receives data from multiple sensors or each sensor may have its own dedicated CPU.

Figures 1A, 1B:
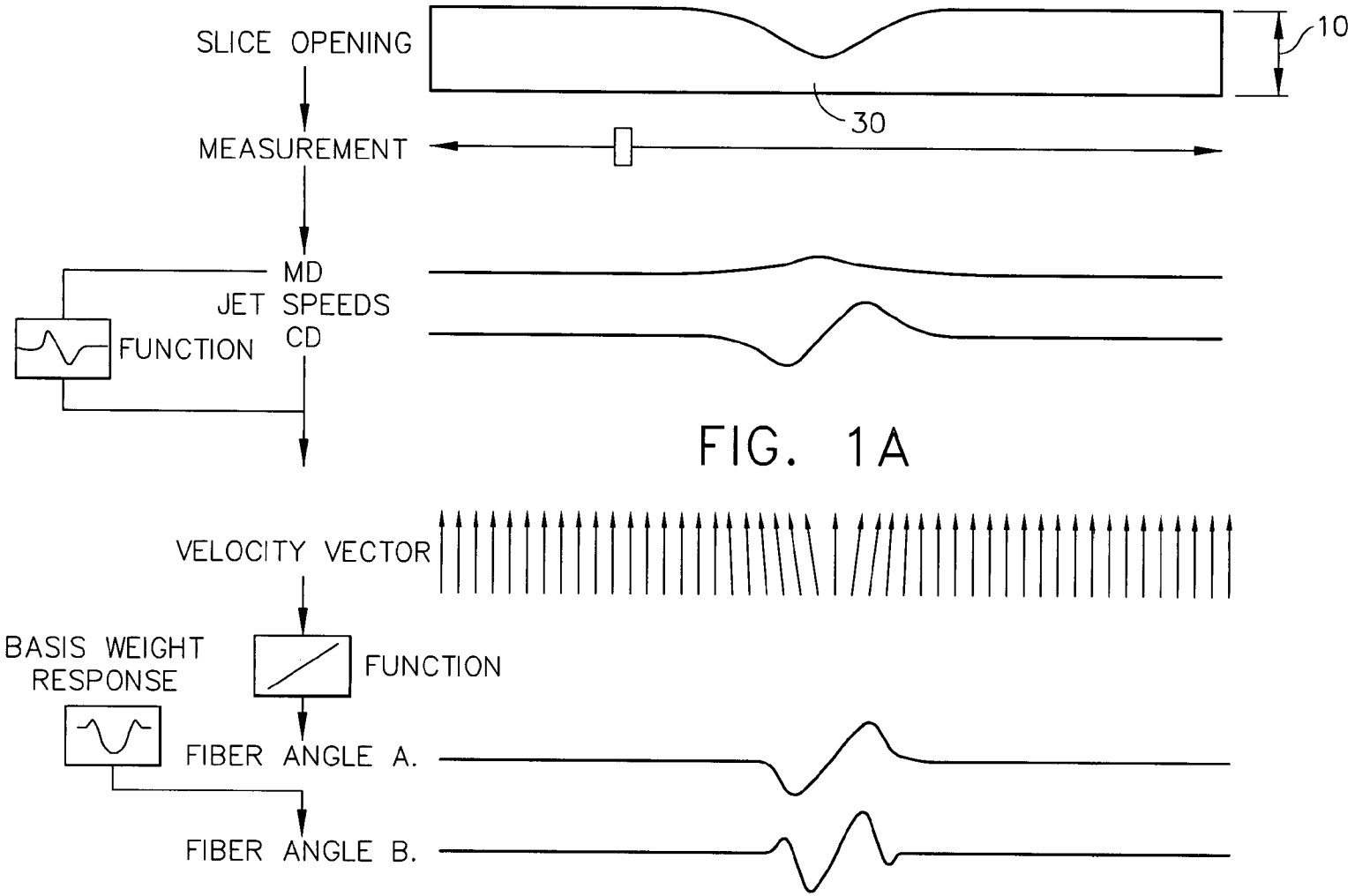
FIGS. 1*a* to 1*b* show schematically how adjustments to the slice opening affect slurry flow through the opening.

It is contemplated that a single measurement with the sensor array of the present invention is sufficient to establish the fiber orientation at a particular control slice of the slice lip. For example, by starting with a perfectly uniform slice lip opening, it is possible for the slice opening 10 to be decreased at one location 30 as illustrated in FIG. 1*a*. This will result in a change in the flow in location 30 and neighbouring locations of the jet, such that part of the flow in the headbox nozzle is deflected from location 30 to neighbouring locations, as illustrated in FIG. 1*b*. This happens because the same pressure forces the slurry through the modified slice opening, however, there is now less area for the slurry to exit the headbox. Therefore, the jet will accelerate and fan out at location 30 producing velocity vectors that angle slightly to the sides off the machine direction. With this flow pattern in mind, the details of this altered flow can be accurately modeled to transform measurements of jet speed from a single scan into velocity vector profiles. From the point at which the velocity vector profile is established, it is then possible to make a transformation to fiber orientation through something as simple as a linear equation with minor corrections for machine specific configuration. It is also possible to make the transformation to a basis weight through a different function.

Figure 2:
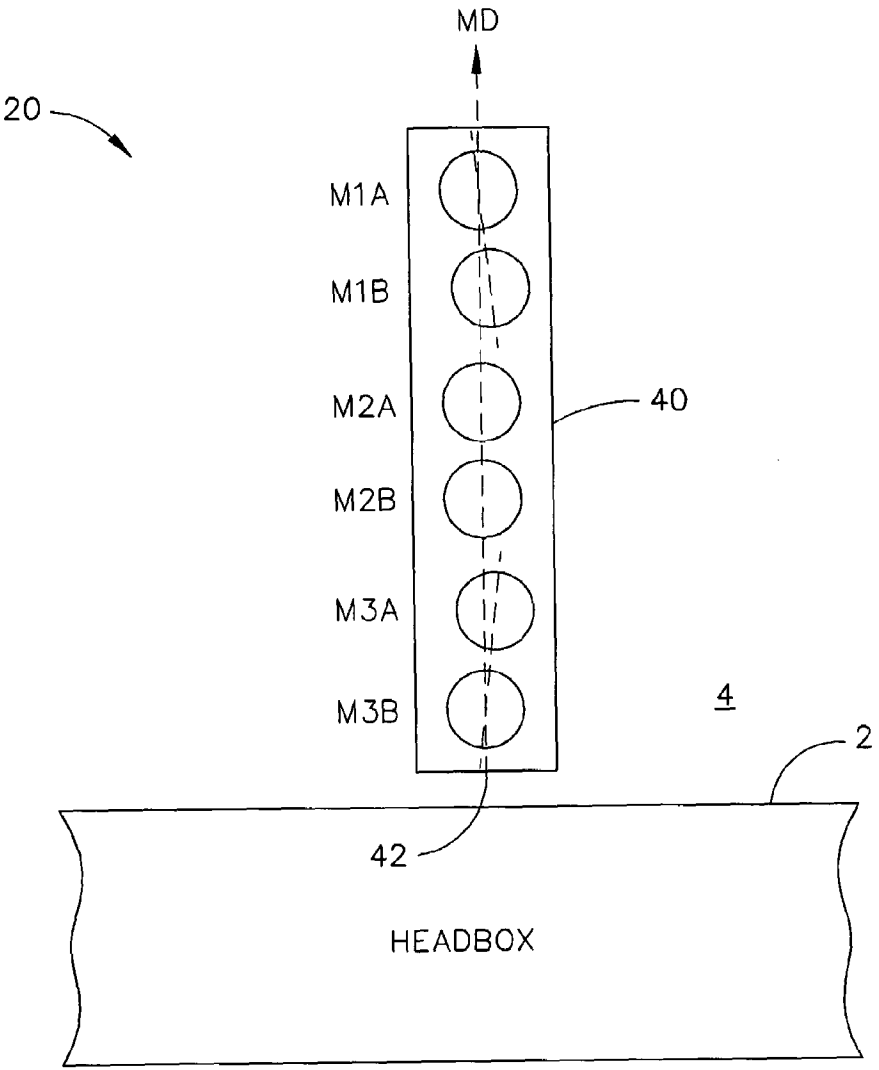
FIG. 2 is detail plan view showing schematically a first embodiment of the present invention with multiple sensors.

FIG. 2 shows an exemplary sensor array 20 organized according to a first embodiment of the present invention in which multiple velocity sensors M1A to M3B are mounted to a sensor body 40 which is located in close proximity to the jet 4. FIG. 2 provides a schematic plan view of sensor array 20. Each sensor is oriented to observe the same point 42 of jet 4 at any given time as the jet emerges from the headbox, but with some angle between each sensor. The illustrated preferred embodiment uses three sensors: a first central sensor made from a sensor set M2A and M2B are aligned with the machine direction, a second sensor formed from sensor set M1A and M1B are aligned at small angle rotated counter-clockwise from the machine direction, and a third sensor formed from sensor set M3A and M3B are aligned at a small angle rotated clockwise from the machine direction. Sensors M1A to M3B are optical speed measurement sensors. For example, each sensor can be a Laser Doppler velocimeter as described above in the background of the invention, or a Dantec Sensorline 7530™ sensor as manufactured by Dantec Dynamic A/S of Denmark or equivalent. Effectively, the angled sensors are at angles to the paper path on either side of the central sensor. The sensors simultaneously measure the velocity components of the jet emerging from headbox at point 42. When combined with the screen speed, this data is used to calculate the velocity vector of the jet for subsequent transformation into fiber orientation information as set out above.

FIG. 2 shows an example of one sensor arrangement. It will be apparent to a person skilled in the art that other arrangements are possible. The sensors may be arranged as an irregular rosette or other configuration. Furthermore, it is not necessary for any measurement direction to coincide with the machine direction as long as the measurement angles of the sensors are known.

In sensors based on cross-correlation of measurements at plural proximal spots in the flow, such as the aforementioned Dantec SensorLine 7350, or the abovementioned U.S. Pat. No. 4,856,895, it is possible to measure the flow correlation in directions formed by pairs of spots additionally or alternatively to measuring the flow velocity in said directions. The flow correlation value can be taken to be the maximum of the cross-correlation, or can be taken to be the cross-correlation at a particular lag time. A particular lag time can be chosen to approximately correspond to the expected flow velocity, and in this case, there is no need to evaluate the cross-correlation at other lag times, so that the measurement device can be very fast in operation. This flow correlation measurement is maximum when the spot pair is aligned in the same direction as the flow, and decreases as the difference between the alignment direction of the spot pair and the flow direction is increased. When the difference in alignment is large, the correlation is low, being essentially random. The measurement of flow correlation can be independent of the measurement of flow velocity by using a fixed lag time in the cross-correlation of two measurement spots.

Figure 3A:
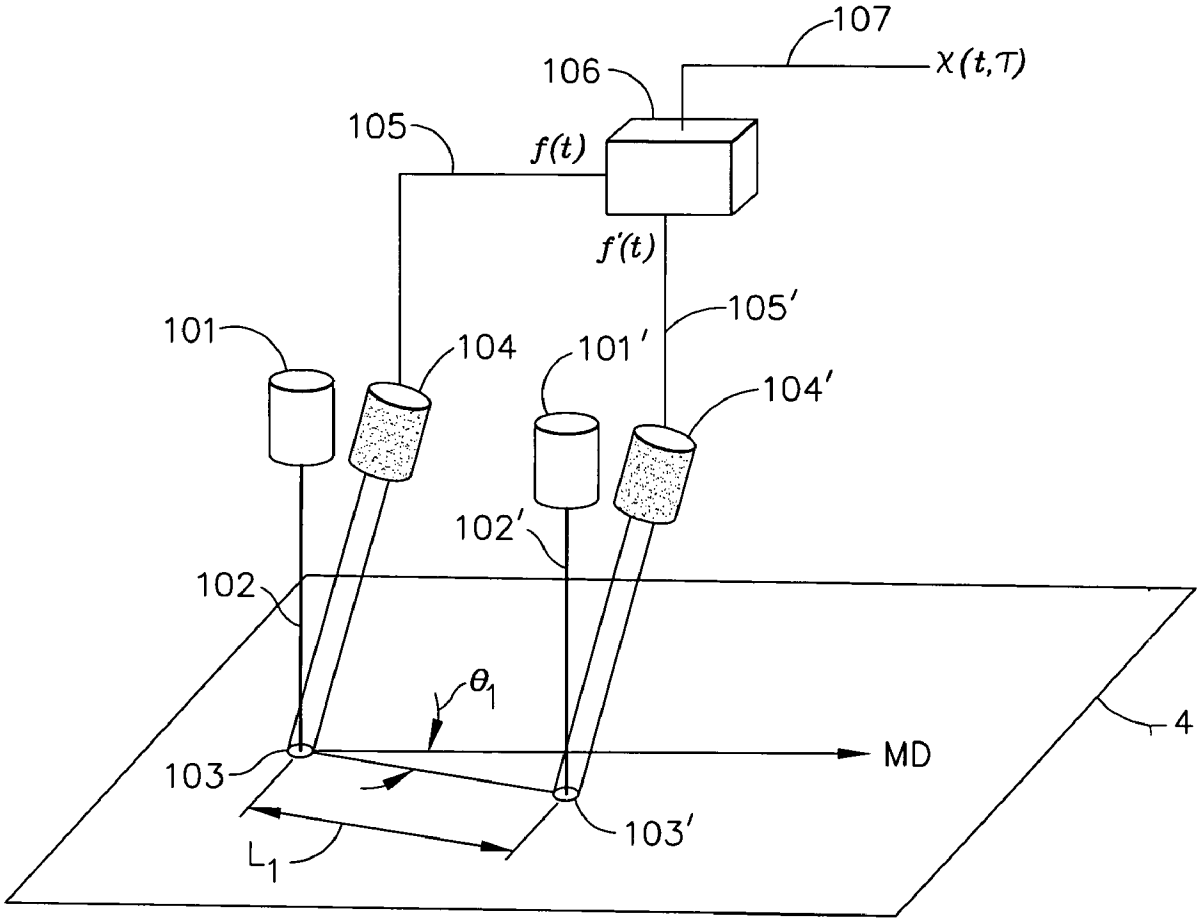
FIGS. 3*a*, 3*b* and 3*c* depict measurement apparatus for measuring the flow correlation value of the jet flow at one or more angles to the flow direction.

FIG. 3*a* schematically depicts an exemplary device for measuring the flow correlation, of greater simplicity and compactness than the previously mentioned devices. The surface of the jet 4 is moving approximately but not necessarily uniformly in the machine direction, marked by an arrow MD. A first illuminator 101 directs a beam 102 of electromagnetic radiation onto a first small region 103 of the surface of the jet 4. The width of the illuminated region 103 preferably does not exceed 3 millimeters, and most preferably does not exceed 1 millimeter in any direction. The radiation can be ultraviolet or visible light, or in a suitable infra-red or microwave band, and it need not be monochrome or coherent but is preferably unpolarized with a low divergence angle. Some of the incident radiance is remitted, by one or more physical mechanisms such as specular reflection, scattering, fluorescence, or refraction, occurring at the surface of the jet or from points within the jet. Radiation remitted from part or ail of the first illuminated region 103 is measured by a first detector 104 responsive to such radiance, and is converted to a first signal 105, whose magnitude is $f(t)$ at measuring instant t. A second illuminator 101', which is preferably similar to the first, directs a beam 102' onto a second small region 103' of the jet 4. The center of the second illuminated region 103' is at a known small displacement $L_1$ downstream from the center of the first illuminated region 103, at a known angle $\theta_1$ with respect to the machine direction, MD. The displacement between illuminated regions preferably does not exceed 3 centimeters, and most preferably does not exceed 1 centimeter. The angle with respect to the machine direction preferably does not exceed 1.5 degrees, and most preferably does not exceed 0.5 degree, and is preferably known with an accuracy of better than 0.03 degrees. Radiation remitted from part or all of the second illuminated region 103' is measured by a second detector 104' responsive to such radiance, and is converted to a second signal 105', whose magnitude is $f(t)$ at measuring instant t. The first signal 105 and second signal 105' are received by means 106 for forming a cross-correlation 107 between the signals, which is $\chi(t,\tau)$ at measuring instant t for a correlation lag of $\tau$ between the signals.

Lenses, mirrors, optical fibers, and other optical elements are not shown in FIG. 3*a*, but can obviously be employed to ensure the illumination is directed onto the desired regions 103, 103', and that the illumination beams 102, 102' have small enough divergence angles that only negligible amounts of radiance are incident on the jet outside the intended regions 103, 103'. Similarly, lenses, mirrors, optical fibers, and other optical elements can be used to ensure that the detectors 104, 104' measure primarily radiances emanating from the illuminated regions 103, 103', and receive only negligible amounts of radiance from outside these regions. Also, filters or gratings and slits or other such elements can be used to ensure the illumination is in its desired spectral range, and to limit the detection of remitted light to its desired spectral range. The spectral ranges for illumination and detection need not be identical, especially in the case that fluorescence contributes significantly to the remitted radiance.

In one variant, optical fibers or light pipes are used to direct the illumination beams 102, 102' from the illuminators 101, 101' onto the jet, and optical fibers or light pipes are used to convey the remitted radiances from the illuminated regions 103, 103' to the detectors 104, 104'. This allows the illuminators 101, 101' and the detectors 104, 104' to be located at a convenient place, remote from the harsh environment near the jet. It also allows the assembly traversing above the jet surface to be more compact and robust, requiring only a set of fiber optic or light pipes leading to other optics such as lenses on the traversing assembly.

The detectors 104, 104' can form signals which are analog or digital representations of the magnitudes of the detected radiances. Similarly, the means 106 for forming a cross-correlation can operate on analog or digital principles, and can produce the cross-correlation 107 in an analog or digital form. The means 106 may also comprise means for transforming signals between analog and digital forms. A digital cross-correlation can be formed, for instance, by use of a dedicated programmable microprocessor, while an analog cross-correlation may be formed, for instance, by means of electrical circuits.

Whether in analog or digital representations, the signals 105, 105' and the cross-correlation 107' are preferably conveyed electrically in wires, or electromagnetically wirelessly or in optical fibres. However, they could be conveyed by other methods also, such as using mechanical or pneumatic or hydraulic couplings.

The cross-correlation may be computed according to any of several generally accepted principles, being a well-known procedure in the art of signal processing.

Without loss of generality, one method of digitally forming a cross-correlation can be given for the simple case where the measurements of remitted light are made essentially simultaneously in the two detectors 104, 104', and the instants of time at which measurements are made are separated by equal intervals of time so that successive measurements form a regular time series. In this case, on or after measurement instant $t_i$ the cross correlation for a lag of k measurement intervals, based on measurements at N+1 instants $t_{i-N} \ldots t_i$ at the second detector 104', and on measurements at N+1 instants $t_{i-N-k} \ldots t_{i-k}$ at the first detector 104, can be formed as $$\chi(t_i, k) = \frac{\sum_{j=0}^{N} f(t_{i-j-k}) f'(t_i)}{\sqrt{\sum_{j=0}^{N} f(t_i) f(t_{i-j-k}) \sum_{j=0}^{N} f'(t_i) f'(t_{i-j-k})}} \tag{1}$$

The computation of cross-correlation can be performed for a single lag, or for plural lags. Since there is no reason to identify the lag of maximum correlation, which would be equivalent to measuring the jet speed, a single suitably chosen lag time can suffice. Alternatively, if plural lag times are used, they need not be closely spaced. Indeed, the measurement instants can be separated by far greater intervals than would be possible for a device which was intended to measure jet speed, so that the detectors 104, 104' need not be sophisticated or expensive.

Moreover, the computation of cross-correlation need not be performed after every measurement instant, but can be performed every M measurement intervals, where M need not be the same as N, and can be greater than or less than N. Alternatively, the computation of cross-correlation can be performed as needed, rather than on a regular schedule.

To further reduce the computational burden, and thus facilitate use of less expensive signal processing components 106, the denominator term on the right hand side of (1) need not be evaluated for every computation of the cross-correlation, and if the number N+1 of measurements used is large enough, it will be essentially constant for each process state, and need be evaluated only when the process state changes. Indeed, if the characteristics of the device and process are known well enough, the denominator can be replaced with a constant or omitted entirely. In the case that the denominator is the number of samples N+1 used in the computation, the result is the covariance of the two signals $f$ and $f'$ for a lag of k measurement intervals, rather than their cross-correlation.

Since the maximum of cross-correlation and the maximum of covariance between the signals will coincide such that for a given lag time both maxima will occur at the angle corresponding to the jet direction, the two quantities arc equivalent for the purposes of this invention, and references to flow correlation may be interpreted to be either the cross-correlation or the covariance of the flow, both of which can be used with equal validity in determining the jet angle. The flow correlation value can be taken to be the cross-correlation or the covariance at a chosen lag time, or can be taken to be the cross-correlation or the covariance at that lag time for which the formed cross-correlation or covariance has its greatest magnitude.

The computation (1) may also be replaced with more sophisticated algorithms, particularly if the measurement instants are not simultaneous in the first and second detectors, or if the measurement instants are irregular or otherwise not separated by equal intervals of time.

Obviously, plural measurement devices for flow correlation may be aligned at different angles relative to the machine direction, in much the same fashion as depicted for jet speed measurement devices in FIG. 2.

Figure 3B:
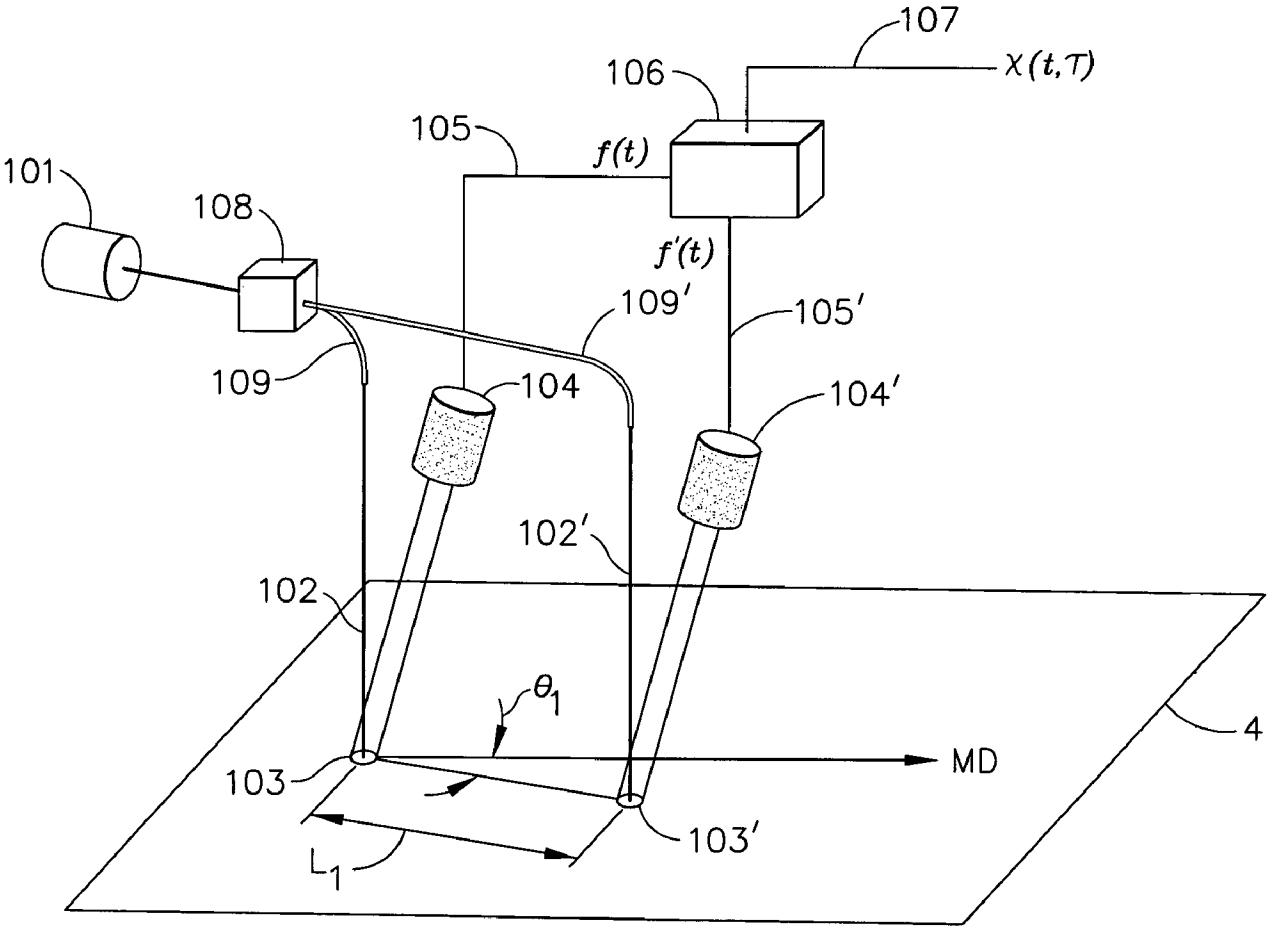

FIG. 3*b* shows a variant embodiment of a flow correlation measuring device, in which the two illumination beams 102, 102' are formed of radiance from a single illuminator 101. Radiance from the illuminator 101 is incident on the port of a fiber optic bundle 108 forming a beam splitter, whence one part 109 of the fiber bundle conveys radiance to form a first illumination beam 102, and another part 109' of the fiber bundle conveys radiance to form a second illumination bean 102'. In other aspects, the device of FIG. 3*b* is the same as that of FIG. 3*a*. Obviously, this method can also be used to divide radiance from a single illuminator into more than two beams. Other forms of beam splitter are known, such as prisms or mirrors, and could be used instead of bundles of optical fibers.

Flow correlation measurement devices as described above, each comprising a pair of illuminated spots and corresponding detectors, cross-correlators, and so forth, can be arranged in a sensor array in much the same way as was earlier shown for a jet speed sensor array 20 in FIG. 2.

Figure 3C:
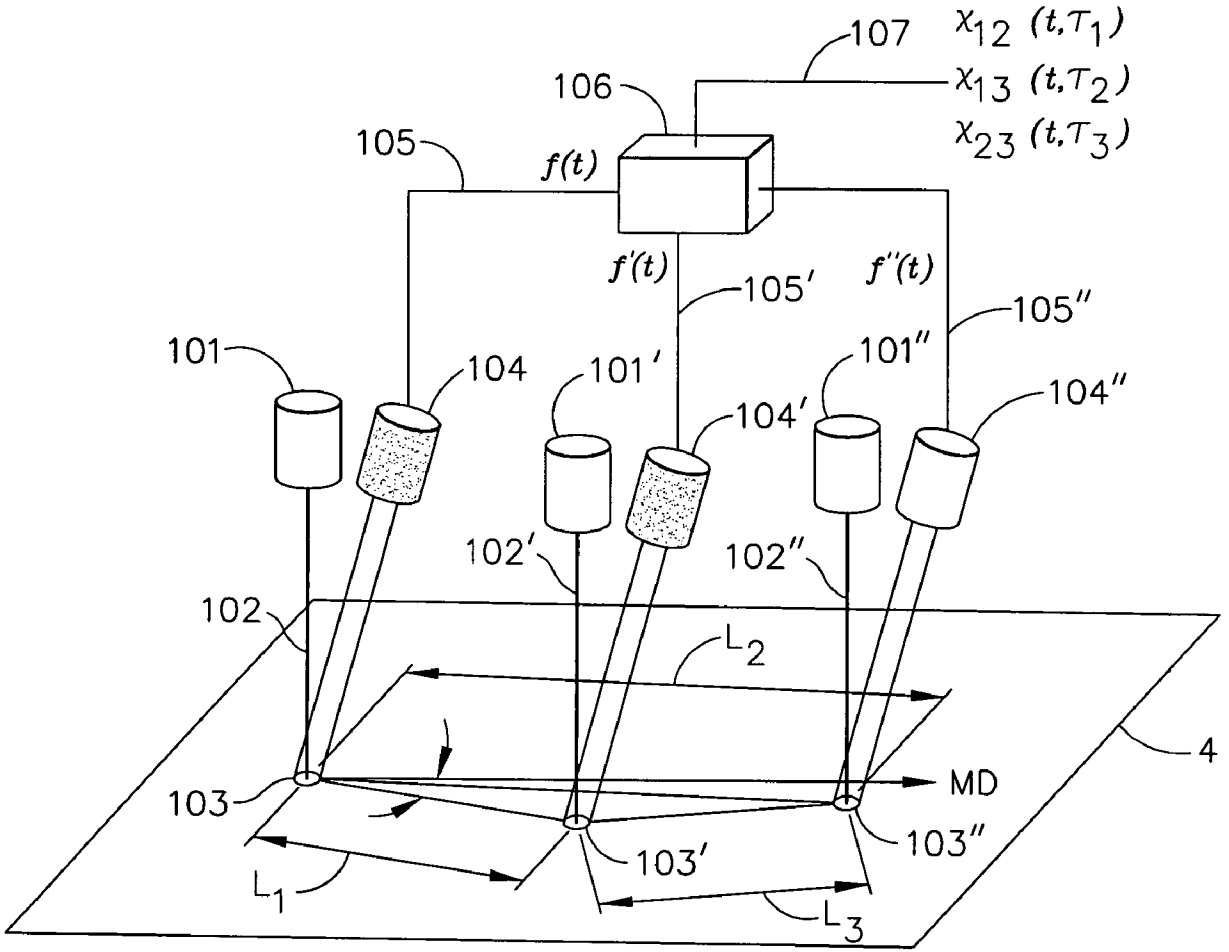

FIG. 3*c*. shows yet another variant embodiment, in which the flow correlation is measured at plural alignment angles using a minimum number of illumination beams and detectors. In addition to the elements described above for FIG. 3*a*, a third illuminator 101", which is preferably similar to the first and second, directs a beam 102" onto a third small region 103" of the jet 4. The center of the third illuminated region 103" is at a known small displacement $L_2$ downstream from the center of the first illuminated region 103, at a known angle $\theta_2$ with respect to the machine direction, MD. Radiation remitted from part or all of the third illuminated region 103" is measured by a third detector 104" responsive to such radiance, and is converted to a third signal 105", whose magnitude is $f'(t)$ at measuring instant t. The third signal 105" is also received by the means 106 for forming a cross-correlation. In this case, the means 106 forms plural cross-correlations 107. A first cross-correlation $\chi_{12}$ can be formed between the signals $f(t)$,$f'(t)$ from the first and second detectors, and a second cross-correlation $\chi_{13}$ can be formed between the signals $f(t)$, $f'(t)$ from 25 the first and third detectors. If the distances and alignment angles between the illuminated regions are suitably chosen, then it is also possible to form a third cross correlation $\chi_{23}$ between the signals $f(t)$,$f'(t)$ from the second and third detectors. For this to be possible, the center of the third illuminated region 103" must be located at a known small displacement $L_3$ approximately downstream from the center of the second illuminated region 103+ at a sufficiently small known angle $\theta_3$ with respect to the machine direction. Thus flow correlations at two or three angles can be formed using three detectors. If a single lag time is used in forming each of plural such cross-correlations it preferably is proportional in each case to the distance between the respective illuminated regions, where the proportionality factor is the inverse of a chosen nominal jet speed, which need not correspond to an actual jet speed.

Accordingly, at least one lag time $\tau_1$ used in forming the cross correlation $\chi_{12}$ is preferably approximately equal to the distance $L_1$ between regions 103 and 103' divided by said nominal jet speed. Exact equality is not necessary, and is anyway not always possible, since the finite interval of time between measurements constrains the choice of lag times. Similarly, at least one lag time $\tau_2$ used in forming the cross correlation $\chi_{13}$ is preferably approximately equal to the distance $L_2$ between regions 103 and 103" divided by said nominal jet speed. If cross-correlation $\chi_{23}$ also is calculated, at least one lag time $\tau_3$ used in forming the cross correlation $\chi_{23}$ is preferably approximately equal to the distance $L_3$ between regions 103' and 103" divided by said nominal jet speed. In this way, the plural cross correlations will produce values which are directly comparable.

A means of forming cross-correlation can form the cross-correlation for a single pair of signals, such that plural means are required to form plural cross-correlations. Alternatively, a means of forming cross-correlations can form cross-correlations for more than one pair of signals, such that the number of means for 20 forming cross-correlations can be less than the number of cross-correlations which are formed. Other arrangements of plural illumination beams and detectors are possible, and it is not necessary or even practical to compute flow correlations using every pair of detectors. For instance, if in FIG. 3*c* the regions 103, 103" illuminated by downstream beams 102', 102" were at approximately the same distance from the region 103 illuminated by the first beam 102, but at significantly different angles, then computing a flow correlation using measurements from the second and third detectors would be pointless. Clearly, the apparatus of FIG. 3*c* could also be modified to employ beam splitters, such that radiance from an illuminator is used to form at least two of the illumination beams.

Figure 4:
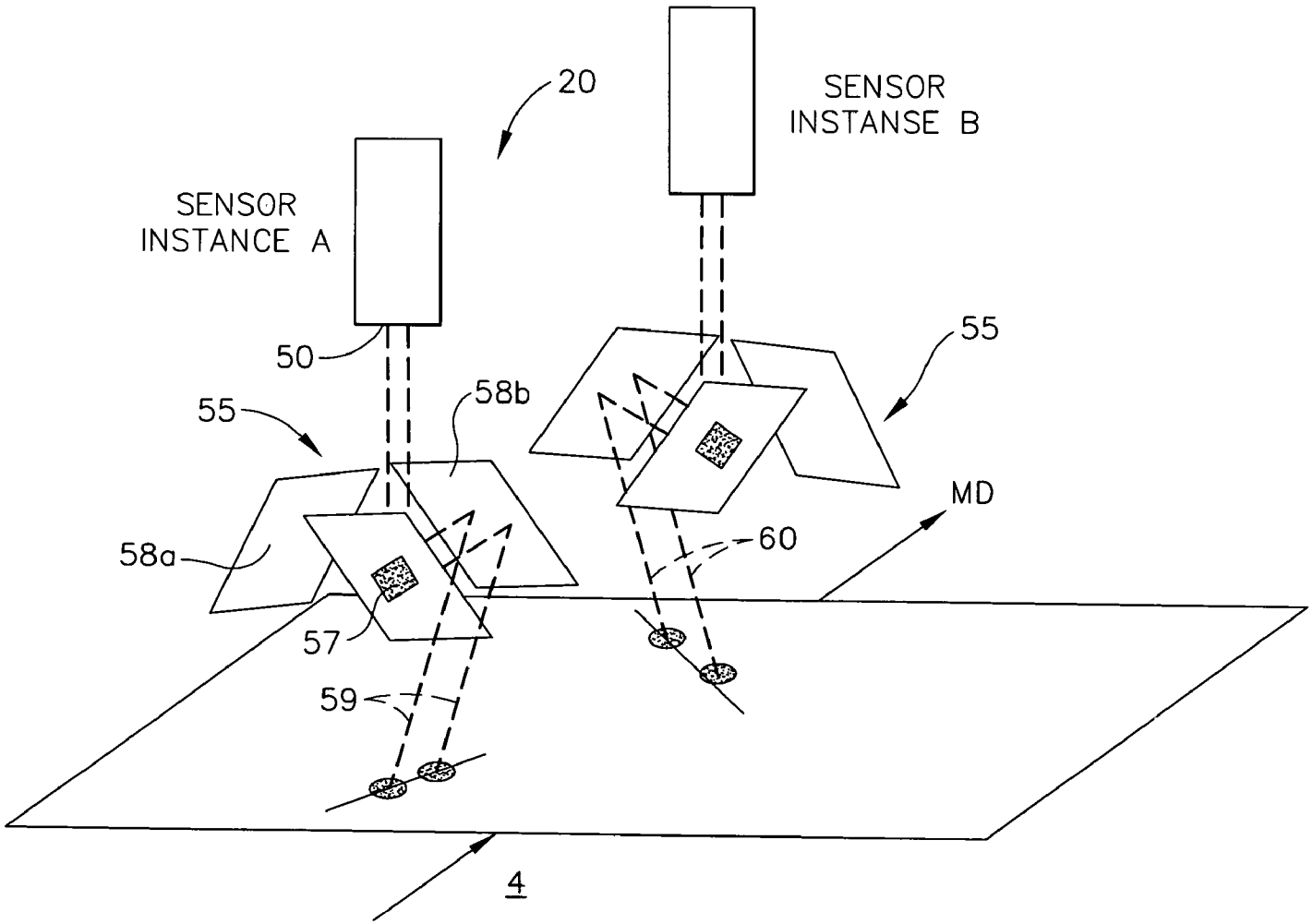
FIG. 4 is detailed plan view showing schematically a second embodiment of the present invention which relies on sensors and movable scanning mirrors.

FIG. 4 shows an alternative arrangement for sensor array 20. In this arrangement, each sensor array comprises a pair of sensors 50 which are positioned adjacent an array 55 of mirrors to permit rapid successive measurements of jet velocity from two or more distinct angles. Preferably, the array of mirrors includes a movable mirror 57 adjacent to two fixed mirrors 58*a* and 58*b*. Mirror 57 may be a mirror and voice coil motor (VCM) combination. Depending on the rotated position of movable mirror 57, sensors 50 detect a measurement point at jet 4 along a first optical path 59 or a second optical path 60. Each optical path is defined by movable mirror 57 in combination with one of mirrors 58*a* and 58*b*. Mirror 58*a* points toward a measurement point at one angle to the machine direction of the web, while mirror 58*b* points to the same measurement point but at a different angle. In this manner substantially simultaneous data of the velocity vector of the jet at the same measurement point is collected. Sensors 20 may also obtain velocity vector information for the jet at a position parallel to the machine direction (MD). Such velocity vector data parallel to the machine direction is not necessary but may be beneficial to the calculation of the velocity vector. In embodiments comprising essentially simultaneous measurements of jet velocity data in at least three known angles, it is preferable for at least one known measurement angle to coincide substantially with the machine direction.

In all of the above-described embodiments, sensor array 20 may be associated with each slice lip actuator. Alternatively, a single sensor array 20 may be mounted for scanning movement in the cross-machine direction. Such a scanning sensor array would move parallel to the slice lip.

In a further embodiment, at least one sensor is used to measure the jet velocity in at least two angles to the machine direction by traversing the at least one sensor across the jet, such that not all jet velocity measurements at each measurement location are made with the same traverse speed and direction. By comparing forward and reverse scans together, possibly averaging several sets of forward and several sets of reverse scans, the velocity vector can be calculated based on the differences induced in the measured velocity profiles due to the differential speeds of scanning forwards and backwards. When jet velocity measurements are made with bidirectional traversing, in both forward and backward traverses, or when they are made with at least two sensors which are not all aligned at the same angle relative to the machine direction, it is not necessary for the traverses to be at different traverse speeds. However, it is advantageous to employ plural speeds in a sequence of traverses, as this provides jet velocity measurements at additional angles. With judicious choice of traverse speeds, the set of measurement angles can be selected to allow a more robust estimate of the jet velocity vector profile. The traverse speeds obviously can be adjusted based on the measured or estimated jet speed to provide the desired measurement angles. This is advantageous when the jet speed is changed, or when the desired measurement angles are changed.

To clarify and elaborate on the above, let us now describe in detail an exemplary form of the computations which can be used to estimate the jet angle and corresponding fiber orientation angle at a location in the jet. The methods and computations of the present invention are not, of course, limited to these simple examples, which are provided only to clarify the principle.

Figure 5B:
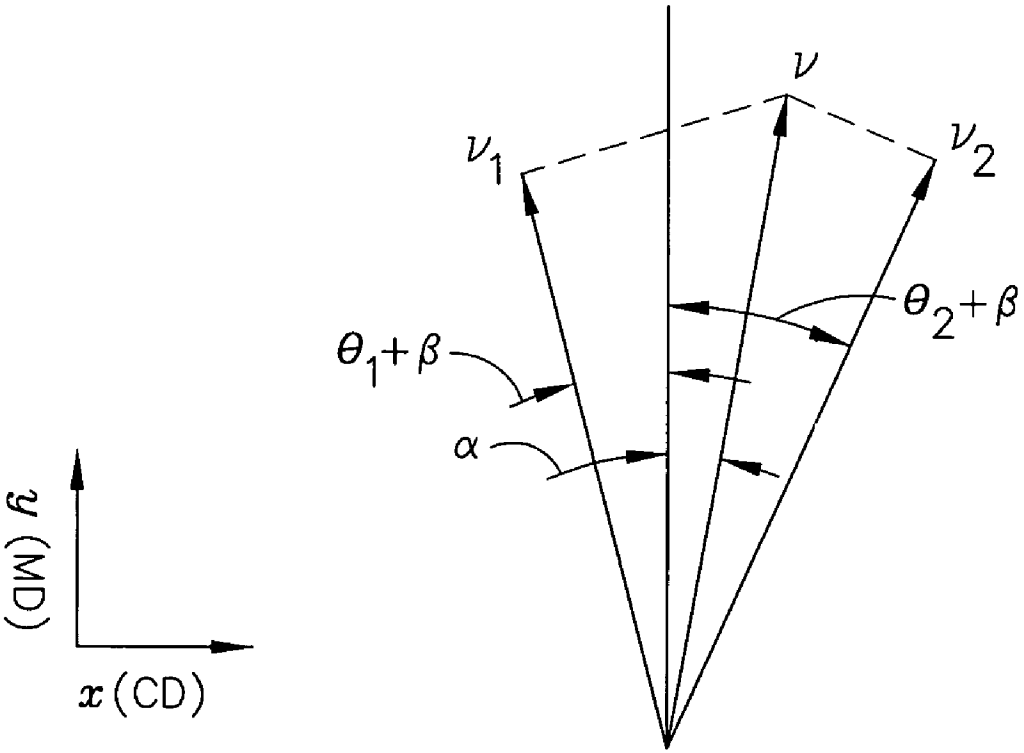
FIGS. 5*a* and 5*b* are schematic views showing measuring angles used for a further embodiment of the present invention which relies on a sensor being scanned in a direction transverse to the machine direction.
Figure 5A:
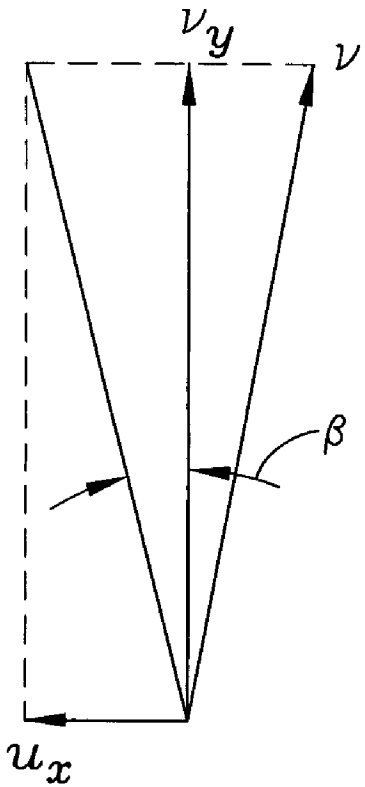

The geometry of measurement is depicted in FIGS. 5*a* and 5*b*. Note that angles and CD components are greatly exaggerated for clarity. By convention, counterclockwise angles are positive. Let the machine direction (MD) be represented as the y axis, and let the cross-machine direction (CD) be represented by the x axis.

Let the local jet velocity vector at a location be denoted v, so that its projection onto the machine direction is $v_y$. If a sensor is traversing in the cross-machine direction at traverse speed $\mu_x$, which is usually much less than the jet speed, then the bias angle $\beta$ due to the traverse speed can be estimated as:

$$\beta = \tan^{-1}\left(\frac{u_x}{v_y}\right) \approx \frac{u_x}{|v|} \tag{2}$$

where the approximation is accurate only when the ratio is small. This is depicted in FIG. 5*a*. The bias angle will be positive when traversing in one direction, and negative when traversing in the opposite direction.

As shown in FIG. 5*b*, let a jet velocity sensor be aligned at an angle $\theta_1$ relative to the machine direction, so that its measurement angle with respect to the machine direction is $\beta+\theta_1$ when it is traversing with a bias angle $\beta$. Let the local jet angle relative to the machine direction be $\alpha$. Thus, the jet velocity measured by the traversing sensor will be the projection of the magnitude of the jet velocity vector onto the measurement direction, which is at an angle $\beta+\theta_1-\alpha$ relative to the jet direction. FIG. 5*b* also shows the angles for a second sensor, aligned at an angle $\theta_2$ relative to the machine direction. The sign conventions for all angles should be consistent, and must be taken into account when combining angles in computations.

In one aspect of the invention which was described above, the jet velocity is simultaneously measured at plural angles relative to the machine direction. Let measurements at two such angles be $v_1$ and $v_2$, measured according to the geometry in FIG. 5*b*:

$$v_1=|v|\cos(\beta+\theta_1-\alpha)$$

$$v_2=|v|\cos(\beta+\theta_2-\alpha) \tag{3}$$

The pair of equations (3) has an exact solution for $\alpha$ from simple trigonometry, and an approximate solution suitable for small angles:

$$\alpha = \tan^{-1}\left(\frac{v_2\cos(\beta+\theta_1) - v_1\cos(\beta+\theta_2)}{v_1\sin(\beta+\theta_2) - v_2\sin(\beta+\theta_1)}\right) \approx \frac{v_2\cos(\beta+\theta_1) - v_1\cos(\beta+\theta_2)}{v_1(\beta+\theta_2) - v_2(\beta+\theta_1)} \tag{4}$$

where all of the quantities on the right hand side are either known or measured. If more than two sensors are used to measure projections of the jet velocity vector onto more than two directions, then a least-squares or other optimal estimate of the jet angle can be made instead of a direct calculation.

In another aspect of the invention which was described above, jet velocity measurements made by at least one sensor are not all made at the same traverse speed and direction. For simplicity, let the measurements be made with a single sensor, aligned at an angle $\theta$ relative to the machine direction. Let measurements be made in a first traverse with associated bias angle $\beta_\alpha$ and in a second traverse with associated bias angle $\beta_-$. The non-simultaneous velocity measurements $v_+$ and $v_-$, made by the sensor at the same location in the first and second traverses are:

$$v_+=|v|\cos(\theta+\beta_+-\alpha)$$

$$v_-=|v|\cos(\theta+\beta_--\alpha) \tag{5}$$

If the first and second traverses are at the same traverse speed but in opposite directions, then $\beta_-=-\beta_+$. The pair of equations (5) has an exact solution for $\alpha$ from simple trigonometry, and an approximation suitable for use with small angles:

$$\alpha = \tan^{-1}\left(\frac{v_+\cos(\theta+\beta_-) - v_-\cos(\theta+\beta_+)}{v_-\sin(\theta+\beta_+) - v_+\sin(\theta+\beta_-)}\right) \approx \tag{6}$$

-continued $$\left(\frac{v_+\cos(\theta+\beta_-)-v_-\cos(\theta+\beta_+)}{\theta(v_- - v_+)+v_-\beta_+ - v_+\beta_-}\right)$$

Since the measurements are non-simultaneous in this case, it is advantageous to combine measurements from several traverses, and to replace (6) with an averaged computation, or to combine measurements made at a larger plurality of bias angles and to replace (6) with an optimized computation, such as least-squares estimation.

The jet velocity vector can then be expressed in polar form as the jet velocity magnitude and angle, or in Cartesian form as its machine direction and cross-machine direction components, or in any other convenient form to which these forms can be converted.

In another aspect of the invention, at least one sensor measures the jet flow correlation additionally or alternatively to measuring the jet speed. In this case, the measurement is of the correlation of the jet flow at the measurement angle, where the measurement angle is biased by traversing in the same way as for velocity measurements. Let the variation in a sensor's measurement of flow correlation with angle be denoted $\chi(\cdot)$, which in practice is a smooth nearly symmetric function.

Figure 6A:
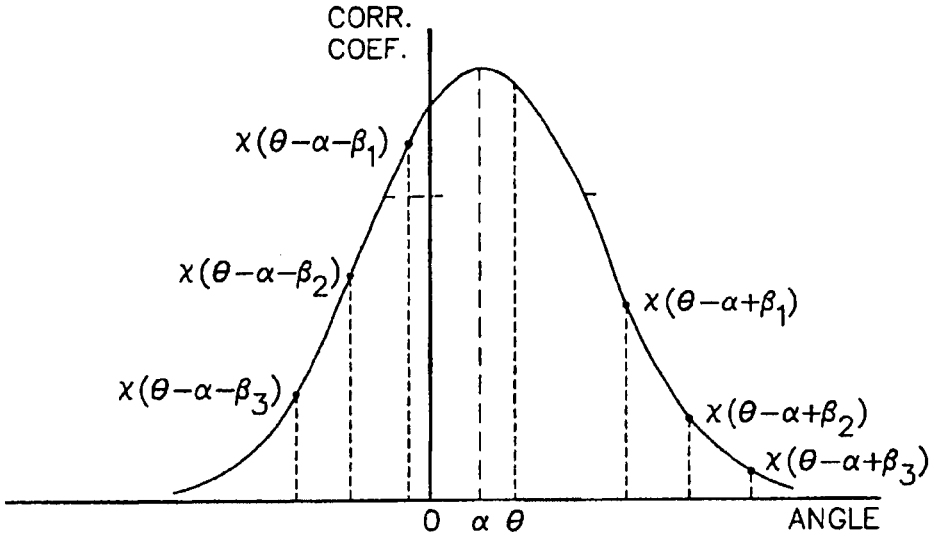
FIGS. 6*a* and 6*b* depict the variation in jet flow correlation with angle relative to the jet flow direction and indicates jet flow correlation measurements made at angles relative to the machine direction which correspond to different traversing speeds and directions.
Figure 6B:
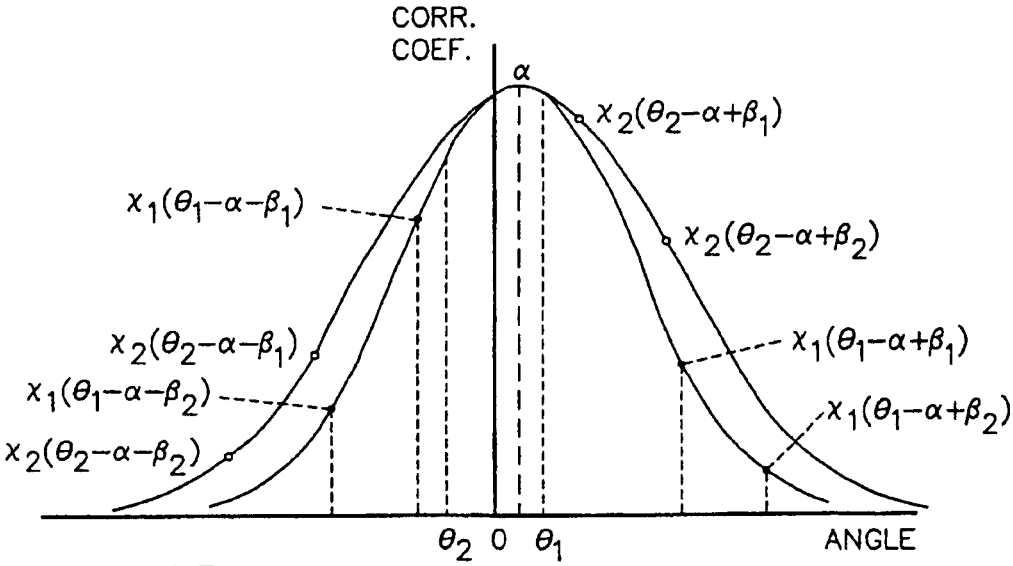

Let a sensor be aligned at angle $\theta$ relative to the machine direction, and let the jet velocity vector be aligned at angle $\alpha$ relative to the machine direction. Let the sensor traverse both forwards and backwards at three traverse speeds, such that the bias angles from traversing are $\pm\beta_1$, $\pm\beta_2$, and $\pm\beta_3$. The flow correlation values are thus measured as depicted in FIG. 6*a*, as six samples of the function $\chi(\theta-\alpha\pm\beta_1)$, $\chi(\theta-\alpha\pm\beta_2)$, and $\chi(\theta-\alpha\pm\beta_3)$. In FIG. 6*a*, and 6*b* following angle 0 represents machine direction. The direction of maximum flow correlation corresponds to the jet flow angle $\alpha$. This can be estimated by any convenient method, such as by least-squares fitting of a suitable function form to the correlation data.

Alternatively, let two sensors be respectively aligned at angles $\theta_1$ and $\theta_2$ relative to the machine direction. Since the sensors may not be identical in performance, let us distinguish their variation in measurement of flow correlation with angle as $\chi_1(\cdot)$ and $\chi_2(\cdot)$. Let the sensors traverse both forwards and backwards at two traverse speeds, such that the bias angles from traversing are $\pm\beta_1$ and $\pm\beta_2$. The flow correlation values are thus measured as depicted in FIG. 6*b*, as four samples of each function: $\chi_1(\theta_1-\alpha\pm\beta_1)$ and $\chi_1(\theta_1-\alpha\pm\beta_2)$ for sensor 1, with $\chi_2(\theta_2-\alpha\pm\beta_1)$ and $\chi_2(\theta_2-\alpha\pm\beta_2)$ for sensor 2. The direction of maximum flow correlation for both sensors corresponds to the jet flow angle $\alpha$. This can be estimated by any convenient method, such as by simultaneous least-squares fitting of suitable function forms to the correlation data from both sensors.

If the two sensors are known to have nearly identical characteristics, then forward and backward traverses at each of two speeds would effectively provide measurements of their common flow correlation function at eight angles.

From the jet angle profile, whether measured using the foregoing flow correlation aspect or the speed triangulation aspect of the invention, it is possible to estimate the profile of fiber orientation angles laid down in the sheet formed of the jet.

For example, using the simplest estimation method, the fiber orientation angle $\phi$ corresponding to a jet angle $\alpha$ a is given by:

$$\varphi = \tan^{-1}\left(\frac{J\sin\alpha}{J\cos\alpha - 1}\right) \tag{7}$$

where J is the local ratio of the machine direction component of jet velocity to the forming wire speed.

In practice, a relation such as (7) may be too simple, and will require various correction factors and additional terms which correspond to the evolution of the jet after the measurement, and the impingement conditions of the jet on the forming wire, and the processing of the sheet after forming. For example, the stretching and shrinking of the sheet which occurs in the dry end of most paper machines will cause the fiber orientation angles measured at the reel to be less than those computed by (7), and the magnitude of this geometric deformation can differ between locations across the sheet. If the cumulative strain fraction in sheet processing in the machine direction at a particular location in the sheet is $\epsilon_y$, and that in the cross-machine direction is $\epsilon_x$, then, the local fiber orientation angle at the dry end $\phi'$ will be:

$$\varphi' = \tan^{-1}\left(\frac{1+\varepsilon_x}{1+\varepsilon_y}\tan\varphi\right) \tag{8}$$

where stretching is a positive strain fraction and shrinking is a negative strain fraction. Also, the fiber orientation angles can differ between the two surfaces of the formed sheet, due to the asymmetric nature of the forming process.

One possible implementation of the above-described measurement approaches, which rely on at least one sensor being scanned back and forth transversely to the machine direction, finds application in a head box configuration where space is limited because of other sheet plies, or equipment in the vicinity. In such a head box configuration fiber optic cables can be used to transfer signals between the measurement points on the jet and the sensors which are located just off machine. This would require a method of handling the constant bending of the fiber optic cables in such a way that a reasonable life expectancy was attained for the cables. One possibility is to have the optic cables come out of the end of a transverse scanning apparatus in a linear fashion, and then role up on a large diameter drum outside of the paper path.

While particular prior art devices have been mentioned to exemplify the measurement of flow velocity or flow correlation, our invention is obviously not limited to embodiments using those devices. In particular, the measurement of flow correlation can be made with less sophisticated devices, as explained above. In embodiments comprising sensors which traverse across the jet, the preferred embodiment is to traverse in a direction substantially perpendicular to the machine direction, and for each traverse to be at an essentially uniform traverse speed. However, traversing along other paths across the jet, including angled or curved paths, is also possible provided the traverse path is known and taken into account in the computations. Similarly, the traverse speed need not be uniform in a traverse, and can vary in predetermined or irregular ways, provided it is known at each location and taken into account in the computations. These and other variations, being obvious to persons of ordinary skill, are contemplated by and within the scope of our invention.

Although the present invention has been described in some detail by way of example for purposes of clarity and understanding, it will be apparent that certain changes and modifications may be practised within the scope of the appended claims.

We claim:

1. A system comprising:

at least one arrangement of sensors for substantially simultaneously measuring a velocity of a jet of liquid and paper-forming fibres emerging from a headbox of a papermaking system in at least two known angles to a machine direction and for generating velocity data;

a memory for storing the velocity data to generate a velocity vector profile of the jet; and a processor for analyzing the velocity vector profile to determine an orientation of the fibres within the jet;

wherein the at least one arrangement of sensors comprises at least three sensor sets, each sensor set having first and second spaced sensors, the sensor sets arranged serially along the machine direction.

2. The system of claim 1, wherein the at least three sensor sets comprise a first sensor set oriented to be aligned with the machine direction, a second sensor set oriented at an angle rotated clockwise to the machine direction, and a third sensor set oriented at an angle rotated counterclockwise to the machine direction.

3. The system of claim 2, wherein the first sensor set is positioned between the second and third sensor sets.

4. The system of claim 3, wherein each sensor comprises a laser doppler velocimeter.

5. The system of claim 1, wherein the at least one arrangement of sensors is mounted for scanning movement transverse to the machine direction in a cross-machine direction.

6. The system of claim 1, wherein the at least one arrangement of sensors comprises a sensor set oriented at an angle to the machine direction.

7. The system of claim 1, wherein the at least one arrangement of sensors comprises multiple sensor arrangements, the sensor arrangements associated with different slice lip actuators of the headbox.

8. The system of claim 1, wherein the at least three sensor sets are not rotatable.

9. A system comprising:

at least one arrangement of sensors configured to substantially simultaneously measure a velocity of a jet of liquid and paper-forming fibres emerging from a headbox of a papermaking system in at least two known angles to a machine direction and to generate velocity data;

a memory configured to store the velocity data to generate a velocity vector profile of the jet; and a processor configured to analyze the velocity vector profile to determine an orientation of the fibres within the jet;

wherein the at least one arrangement of sensors comprises:

multiple sensors; and an array of mirrors comprising:

first and second fixed mirrors each oriented at an angle to the machine direction; and a movable mirror, whereby movement of the movable mirror acts to establish different optical paths that allow the sensors to measure the velocity of the jet at different angles to the machine direction.

10. The system of claim 9, wherein the two fixed mirrors are aimed at a common measurement point at different angles to the machine direction.

11. The system of claim 9, wherein the movable mirror is rotatable, and wherein rotation of the movable mirror establishes the different optical paths.

12. The system of claim 9, wherein the at least one arrangement of sensors comprises multiple sensor arrangements, the sensor arrangements associated with different slice lip actuators of the headbox.

13. A system comprising:

at least one arrangement of sensors for substantially simultaneously measuring a velocity of a jet of liquid and paper-forming fibres emerging from a headbox of a papermaking system at two or more known angles to a machine direction and for generating velocity data;

means for storing the velocity data to generate a velocity vector profile of the jet; and means for analyzing the velocity vector profile to determine an orientation of the fibres within the jet;

wherein the at least one arrangement of sensors comprises at least three sensor sets, each sensor set having first and second spaced sensors, the sensor sets arranged serially along the machine direction.

14. The system of claim 13, wherein the at least three sensor sets comprise a first sensor set oriented to be aligned with the machine direction, a second sensor set oriented at an angle rotated clockwise to the machine direction, and a third sensor set oriented at an angle rotated counterclockwise to the machine direction.

15. The system of claim 14, wherein the first sensor set is positioned between the second and third sensor sets.

16. The system of claim 14, wherein each sensor comprises a laser doppler velocimeter.

17. The system of claim 13, wherein the at least one arrangement of sensors comprises multiple sensor arrangements, the sensor arrangements associated with different slice lip actuators of the headbox.

18. The system of claim 13, wherein the at least three sensor sets are not rotatable.

19. A method comprising:

measuring a velocity of a jet of liquid and paper-forming fibres emerging from a headbox of a papermaking system substantially simultaneously at two or more known angles to a machine direction to generate velocity data;

creating a velocity vector profile of the jet using the velocity data; and analyzing the velocity vector profile to determine an orientation of the fibres within the jet;

wherein measuring the velocity of the jet comprises using a sensor arrangement comprising at least three sensor sets, each sensor set having first and second spaced sensors, the sensor sets arranged serially along the machine direction.

20. The method as claimed in claim 19, wherein the at least three sensor sets comprise (i) sensors oriented to be aligned with the machine direction and (ii) sensors oriented to be aligned at one or more angles to the machine direction.

21. The method of claim 19, wherein measuring the velocity of the jet comprises using multiple sensor arrangements, different sensor arrangements associated with different slice lip actuators of the headbox.

22. The method of claim 19, wherein the at least three sensor sets are not rotatable.

23. A method comprising:

measuring a velocity of a jet of liquid and paper-forming fibres emerging from a headbox of a papermaking system substantially simultaneously at two or more known angles to a machine direction to generate velocity data;

creating a velocity vector profile of the jet using the velocity data; and analyzing the velocity vector profile to determine an orientation of the fibres within the jet;

wherein measuring the velocity of the jet comprises using a sensor arrangement, the sensor arrangement comprising multiple sensors and an array of mirrors, the array of mirrors comprising two fixed mirrors each oriented at an angle to the machine direction and a movable mirror, whereby movement of the movable mirror establishes different optical paths that allow the sensors to measure the velocity of the jet at different angles to the machine direction.

24. The method of claim 23, wherein measuring the velocity of the jet comprises using multiple sensor arrangements, the sensor arrangements associated with different slice lip actuators of the headbox.

25. The method of claim 23, wherein the movable mirror is rotatable, and wherein rotation of the movable mirror establishes the different optical paths.

26. The method of claim 23, wherein the two fixed mirrors are aimed at a common measurement point at different angles to the machine direction.

* * * * *